United States Patent [19]

Ward

[11] Patent Number: 4,830,822

[45] Date of Patent: May 16, 1989

[54] VARIABLE DENSITY ARTICLE AND METHOD FOR PRODUCING SAME

[75] Inventor: Robert L. Ward, Towanda, Pa.

[73] Assignee: GTE Products Corporation, Stamford, Conn.

[21] Appl. No.: 209,136

[22] Filed: Oct. 26, 1987

Related U.S. Application Data

[63] Continuation of Ser. No. 768,994, Aug. 26, 1985, abandoned.

[51] Int. Cl.[4] ..... G22F 3/00

[52] U.S. Cl. ..... 428/547; 428/610; 419/6; 419/23

[58] Field of Search ..... 428/547, 610; 75/228, 75/245, 248; 419/623

[56] References Cited

U.S. PATENT DOCUMENTS

| | | | |
|---|---|---|---|
| 1,510,745 | 10/1924 | Montgomery | 428/547 |
| 2,028,240 | 1/1936 | Palmer | 428/547 |
| 2,267,918 | 12/1941 | Hildabolt | 428/547 |
| 2,464,517 | 3/1949 | Kurtz | 428/547 |
| 3,320,058 | 5/1967 | Krock et al. | 428/547 |
| 3,373,003 | 3/1968 | Schreiner | 428/547 |
| 3,766,769 | 10/1973 | Fuchs et al. | 428/547 |
| 4,357,393 | 11/1982 | Tsuda et al. | 428/547 |

*Primary Examiner*—Stephen J. Lechert, Jr.
*Attorney, Agent, or Firm*—Donald R. Castle

[57] ABSTRACT

A method is disclosed for providing an article having within its integral body a plurality of sections of varying density. The method involves successively loading a die with each of a plurality of powders, each powder having a specific composition and particle size and each powder being loaded in a predetermined amount to result in each section of the final article having a characteristic density, compacting the powders to produce a preformed article, and sintering the preformed article at a sufficient temperature for a sufficient time to produce the final article.

A method is disclosed in which the powders are metal.

A metal article is disclosed which is produced the above methods, with the preferred metals being tungsten powder and molybdenum powder.

4 Claims, No Drawings

VARIABLE DENSITY ARTICLE AND METHOD FOR PRODUCING SAME

This application is a continuation of application Ser. No. 768,994, filed 8-26-85, now abandoned.

BACKGROUND OF THE INVENTION

This invention relates to a method for producing a variable density article by compacting a plurality of powders having different compositions and/or particle sizes, and in specific amounts, followed by sintering at conditions which result in the final article each section of which has a characteristic density. More particularly, it relates to a method in which the powder is metal powder.

It is often necessary and desirable to produce articles having sections of varying density.

One such application of varying density articles is in the specialty lamp industry in which arc and flash lamps are made in which the electrodes have multi-piece construction. For example, the tip of the electrode is about 80%±10% dense tungsten, impregnated with various emitter compounds. The shank of the electrode is dense tungsten (from about 94% to about 100% of the theoretical density) which acts as a heat sink plus a current conductor. The tip and shank are brazed together.

This assembly brazing is difficult and costly to accomplish. If brazing is done before the tip is impregnated, some of the braze is sucked up into the porous tip. This prevents impregnation of the desirable compounds. If brazing is done after impregnation, adherence and contamination problems occur.

An alternate method of making these electrodes, in particular cathodes, is to use tungsten having a density of about 80% of the theoretical density for the entire electrode. The electrodes are expensive and conduct neither heat nor electricity well.

REFERENCES

1. U.S. Pat. No. 3,489,554
2. U.S. Pat. No. 3,684,912

SUMMARY OF THE INVENTION

In accordance with one aspect of this invention, there is provided a method for producing an article having within its integral body a plurality of sections of varying density. The method involves first successively loading a die cavity with each of a plurality of powders, each powder having a specific composition, and particle size and each powder being loaded in a predetermined amount to result in each section of the final article having a characteristic density. The powders are then compacted to produce a preformed article. The preformed article is then sintered at a sufficient temperature for a sufficient time to produce the final article.

In accordance with another aspect of this invention, there is provided a method for producing a metal article having within its integral body a plurality of sections of varying density. The method is essentially the same as the above described method except that the powders are metal powders.

In accordance with another aspect of this invention, a metal article is provided which is produced the method of this invention with the preferred metals being tungsten and molybdenum.

DETAILED DESCRIPTION OF THE INVENTION

For a better understanding of the present invention, together with other and further objects, advantages, and capabilities thereof, reference is made to the following disclosure and appended claims in connection with the above description of some of the aspects of the invention.

A known quantity of one type of powder material having a specific composition and/or particle size is loaded into a die cavity and leveled, and a known quantity of another type of powder material having a characteristic composition and/or particle size is loaded on top of the first powder and leveled. A plurality of powders can be successively loaded in this manner into the die cavity one on top of the other, each powder having a characteristic composition and particle size and being loaded in a predetermined amount.

The quantity, composition, and particle size of the powders are chosen to give the desired densities of the respective sections in the subsequently sintered article under a common set of sintering conditions, the density variations imparting the desired properties in the application.

The powders, having been loaded into the die are then compacted to produce a preformed article.

The resulting preformed article is then sintered at a sufficient temperature for a sufficient time to produce the final article each section of which has a characteristic density.

The above described method can be applied to a variety of powders, for example, refractory metal powders and ceramics. For example, the method would be applicable to making a furnace brick with a relatively dense hard fire resistant face and a less dense porous insulating back.

A metal article having within its integral body a plurality of sections of varying density can be made according to the same general procedure described above except that the powders are metal powders each of which has a specific composition and particle size. The preferred metals of this invention are tungsten and molybdenum.

The method of this invention is preferably used in the production of electrodes, in particular cathodes. One especially preferred article will become evident in the example that ensues.

The articles thus produced have variable density sections within one integral body. The sections can be made of different material compositions and can have densities varying from relatively low to high values. There is no discontinuity at the boundaries of the sections.

The article can be ground or machined as desired to obtain the dimensions desired for the application.

In the practice of the methods of this invention, there is no braze assembling. The quality of the finished article, is better due to elimination of braze contamination. The article is less expensive to make than when brazing is done, and investment in brazing equipment is not required.

To more fully illustrate this invention, the following nonlimiting example is presented.

EXAMPLE

Tungsten metal powder having an average particle size of about 6 microns is loaded into a die cavity followed by tungsten powder powder having an average particle size of about 1.4 microns, followed by molybdenum metal powder having an average particle size of about 3.5 microns. The powders are then pressed to produce a green article having a green density of about 60% of the theoretical density.

The resulting green article is then sintered in a reducing atmosphere at a temperature of about 1800° C. for about 48 hours or equivalent sintering schedule. The resulting sintered article has a 6 micron tungsten section having a density of about 80% of the theoretical density, a 1.4 micron tungsten section having a density of about 95% of the theoretical density, and a 3.5 micron molybdenum section having a density of about 94% of the theoretical density.

The article produced by the above described example is an electrode, in particular, a cathode in which the 80% dense tungsten section is the tip, the 95% dense tungsten section is the body, and the 94% dense molybdenum section is the tail.

While there has been shown and described what are at preset considered the preferred embodiments of the invention, it will be obvious to those skilled in the art that various changes and modifications may be made therein without departing from the scope of the invention as defined by the appended claims.

What is claimed is:

1. A method for producing an article having within its integral body a plurality of sections of varying density, said method comprising:

(a) successively loading a die cavity with each of a plurality of powders selected from the group consisting of tungsten based powder and molybdenum based powder, each powder having a specific composition and particle size, and each powder being loaded in a predetermined amount to result in each section of the final article having an average particle size different from the other powders;

(b) compacting said powders to form a preformed article; and (c) sintering said preformed article at a sufficient temperature and for a sufficient time to produce the final article having portions of different densities.

2. An article produced by the method of claim 1.

3. A method for producing an article having within its integral body a plurality of section of varying density said method of comprising (a) loading a first portion of a die cavity with a first tungsten powder having a first average particle size;

(b) loading a second portion of a die cavity adjacent to said first portion with a second tungsten powder having an average particle size smaller than said first tungsten powder;

(c) filling the remaining portion of the die cavity with molybdenum metal powder having an average particle size intermediate of the other two powders;

(d) compacting the powders to form a preformed article; and (e) sintering the preformed article at a sufficient temperature time and for sufficient time to form the final article whereby the portion of the resulting article corresponding to the first portion in the die cavity has a density less than the density of the portion of the resulting article corresponding to the second portion in the die cavity and the molybdenum portion has a density intermediate the two tungsten portions.

4. The article produced by the method of claim 3.

* * * * *